US007416181B2

(12) United States Patent
Murakami et al.

(10) Patent No.: US 7,416,181 B2
(45) Date of Patent: Aug. 26, 2008

(54) IMAGE FORMING APPARATUS

(75) Inventors: Reiji Murakami, Kanagawa (JP); Masahiro Kodo, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/984,641

(22) Filed: Nov. 20, 2007

(65) Prior Publication Data

US 2008/0073830 A1 Mar. 27, 2008

Related U.S. Application Data

(63) Continuation of application No. 10/921,851, filed on Aug. 20, 2004, now Pat. No. 7,300,050.

(30) Foreign Application Priority Data

Aug. 21, 2003 (JP) ..... 2003-297600

(51) Int. Cl.
*B65H 1/00* (2006.01)

(52) U.S. Cl. ..... 271/162; 271/164; 399/110

(58) Field of Classification Search ..... 271/162, 271/164, 65, 9.09, 301; 399/110
See application file for complete search history.

(56) References Cited

U.S. PATENT DOCUMENTS 5,002,266 A * 3/1991 Kikuchi et al. ..... 271/3.2
5,085,422 A 2/1992 Sagara
5,326,091 A * 7/1994 Giacometto et al. ..... 271/10.01
5,383,655 A 1/1995 Hayakawa et al.
5,418,606 A 5/1995 Kikuchi et al.
5,451,043 A * 9/1995 Arai ..... 271/122
5,765,826 A * 6/1998 Isoda et al. ..... 271/162
5,839,032 A * 11/1998 Yasui et al. ..... 399/124
6,145,832 A * 11/2000 Saito et al. ..... 271/162
6,267,368 B1 7/2001 Tomoe et al.
6,340,157 B1 * 1/2002 Watanabe et al. ..... 271/301

FOREIGN PATENT DOCUMENTS

JP 2001-130757 A 5/2001

* cited by examiner

*Primary Examiner*—Patrick Mackey
*Assistant Examiner*—Kaitlin Joerger
(74) *Attorney, Agent, or Firm*—Foley & Lardner LLP

(57) ABSTRACT

The present invention provides an image forming apparatus in which an automatic double-side unit 81 is provided free to open and close on the side of an apparatus body 1*a*, and a manual paper feeding device 61 is provide adjacent to the automatic double-side unit. And, there are provided manual moving mechanisms 75, 86, 86*a* for moving the manual paper feeding device in a direction away from the side of the apparatus body in association with opening operation of the automatic double-side unit. Further, there is provided a pressure contact release mechanism 90 for releasing pressure contact between a paper feeding roller 67 and a separation roller 66 of the manual paper feeding device in association with opening operation of the automatic double-side unit, whereby when the automatic double-side unit is operated to be opened, an open portion is formed between the manual paper feeding device and the apparatus body in association therewith so as to release restriction of paper sandwiched between the paper feeding roller and the separation roller of the manual paper feeding device.

16 Claims, 7 Drawing Sheets

IMAGE FORMING APPARATUS

CROSS REFERENCE TO RELATED APPLICATION

The present application is a continuation based upon U.S. application Ser. No. 10/921,851, filed Aug. 20, 2004, which claims the benefit of priority from the prior Japanese Patent Application No. 2003-297600, filed Aug. 21, 2003; the entire contents of all of which are incorporated herein by reference.

BACKGROUND OF THE INVENTION

1. Field of the Invention

The present invention relates to an image forming apparatus provided with an automatic double-side unit for reversing paper and a manual paper feeding device.

2. Related Art Statement

In the image forming apparatus, there is an apparatus having a double-side printing function and a manual printing function. This image forming apparatus has the structure that in order to install machines and tools having both functions utilizing a limited space, an automatic double-side unit (ADU) for reversing paper in order to perform double-side printing is mounted on the side of the apparatus body encasing an image forming section, and a manual paper feeding device is mounted adjacent to the apparatus under the automatic double-side unit in order to perform printing by manual paper feeding.

Incidentally, in the image forming apparatus, jamming often occurs in the vicinity of the manual paper feeding device.

In the jam treatment in the vicinity of the manual paper feeding device, work of the jam treatment is difficult because the manual paper feeding device is located in an area for carrying out work for removing the jammed sheets.

In the past, in the image forming apparatus not provided with the automatic double-side unit, the art has been proposed in which by employing the structure in which a manual paper feeding device is provided on an opening and closing cover for carrying out jam treatment provided on the side of the apparatus body, and the manual paper feeding device can be opened to the apparatus body, and the structure in which when the manual paper feeding device is opened, pressure contact between a paper feeding roller and a separation roller of the manual paper feeding device is released, when the opening and closing cover is opened, the jammed sheet is easily removed from a carrier passage of the manual paper feeding device (for example, see Japanese Patent Application Laid-Open No. 2001/130757 Publication).

However, in many of the image forming apparatus having the automatic double-side unit and the manual paper feeding device, both machines and tools are arranged concentrically, that is, the automatic double-side unit and the manual paper feeding device are arranged adjacent to each other on the side of the apparatus body, different from the above-described image forming apparatus not provided with the automatic double-side unit. Particularly, they are arranged adjacent to each other. Due to the presence of the automatic both-side unit, it is difficult for the image forming apparatus having the automatic double-side unit to apply the structure for facilitating removal of the jammed manual paper in association with the opening and closing cover as in the above-described publication.

Therefore, in the image forming apparatus provided with both the automatic double-side unit and the manual paper feeding device, when the jam occurred in the vicinity of the manual paper feeding device is treated, the automatic double-side unit to be an obstacle is moved to expose the manual paper feeding device directly under thereof to outside, after which parts of the manual paper feeding device are operated to remove the paper jammed in the vicinity of the manual paper feeding device. Therefore, in the jam treatment, many works are demanded till arriving the jammed place, as compared with the image forming apparatus not provided with the automatic double-side unit. Particularly, it is hard to find the jammed paper around the manual paper feeding device. Moreover, since the opened portions are not many, it is difficult to secure the work space for carrying out the jam treatment. In addition, there is demanded the work which is troublesome and requires labor, such that the paper sandwiched between the paper feeding roller and the separation roller of the manual paper feeding device is pulled out, and therefore the jam treatment was considerably troublesome.

SUMMARY OF THE INVENTION

It is an object of the present invention to provide an image forming apparatus for easily removing paper jammed in the vicinity of a manual paper feeding device, while being the structure equipped with an automatic double-side unit and a manual paper feeding device.

For achieving the aforementioned object, the present invention employed the structure in which in association with opening operation of an automatic both-side unit provided free to open and close on the side of the apparatus body, a manual paper feeding device adjacent to the automatic double-side unit is moved in the direction away from the side of the apparatus body, and a delivery portion and a separation portion in pressure contact with the manual paper feeding device are released.

According to the present invention, where the jam occurs in the vicinity of the manual paper feeding device, if the automatic both-side unit is operated to be opened, in association therewith the portion between the manual paper feeding device and the apparatus body is opened to form an open space in that portion, and restriction of paper sandwiched between the delivery portion and the separation portion of the manual paper feeding device is released.

Therefore, the jammed paper can be removed easily from an area in the vicinity of the manual paper feeding device with less labor and under the circumstances that work is done easily, such that paper not sandwiched between the delivery portion and the separation portion of the manual paper feeding device is removed through an open space between the manual paper feeding device and the apparatus body.

DETAILED DESCRIPTION OF THE INVENTION

The present invention will be described hereinafter on the basis of one embodiment shown in FIGS. 1 to 7.

Figure 1:
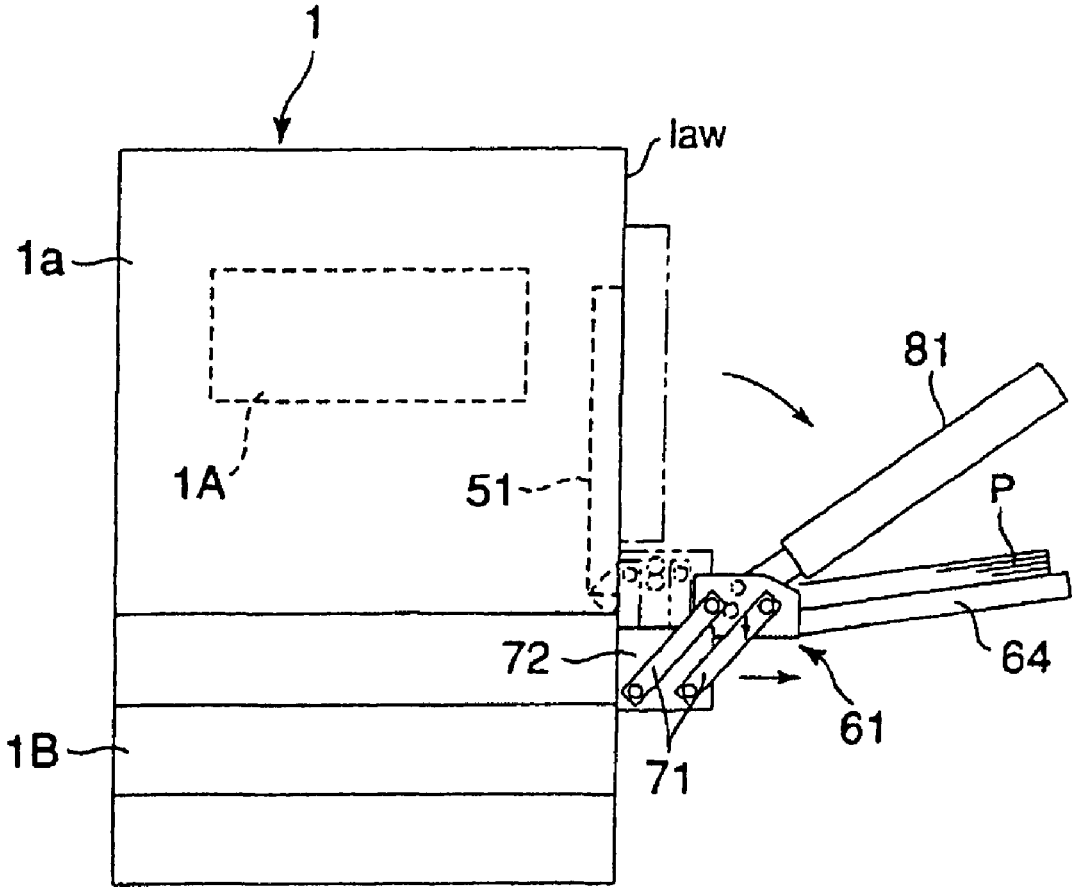
FIG. 1 is a schematic front view showing an electro-photographic copying machine according to one embodiment of the present invention.
Figure 2:
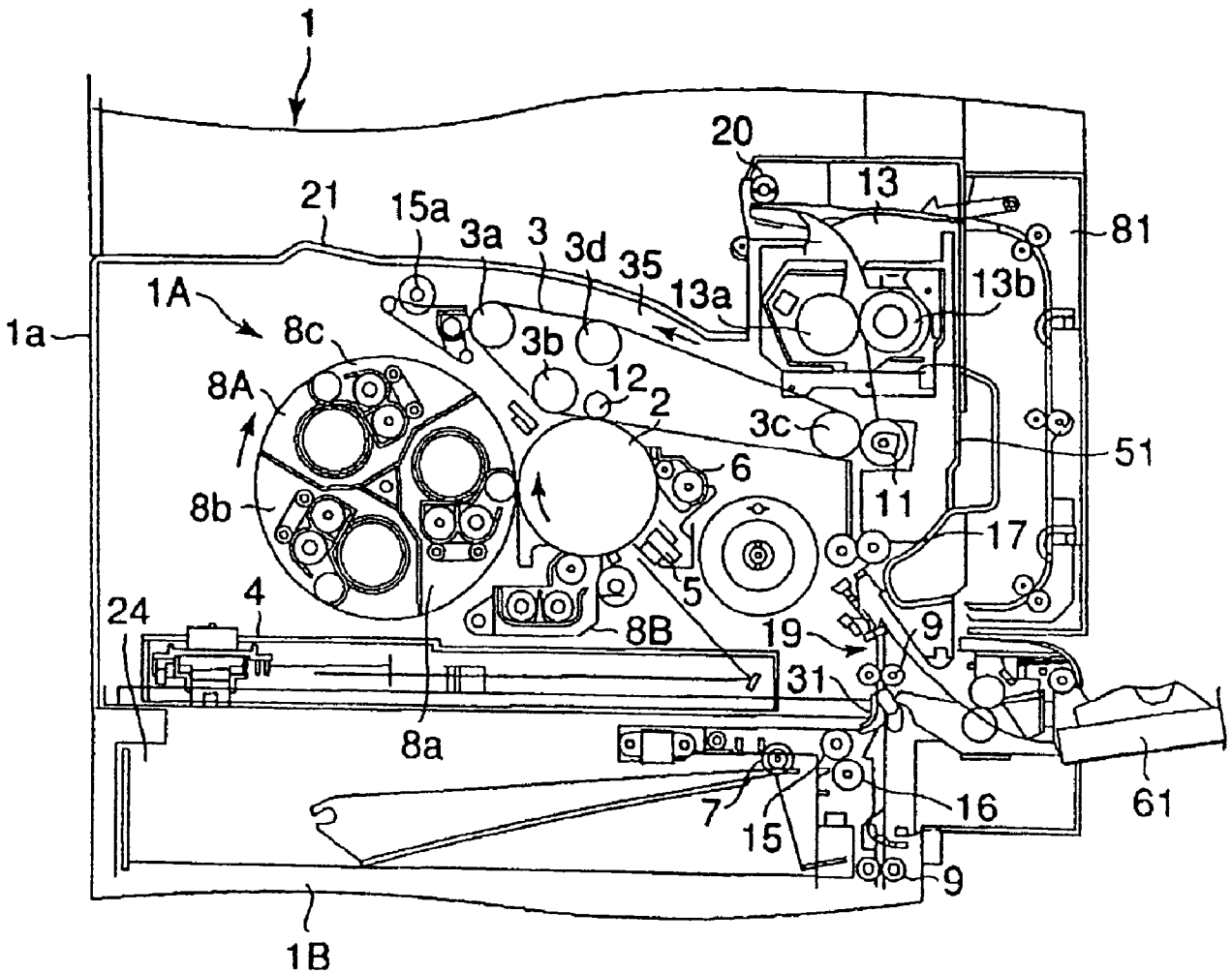
FIG. 2 is a view showing an area around an image forming section of the electro-photographic copying machine of FIG. 1.

In FIGS. 1 and 2, reference numeral 1*a* denotes the copying machine body as the apparatus body provided on an image forming apparatus, for example, an electro-photographic copying machine 1. An image forming section 1A is encased in the upper portion of the copying machine body 1*a*, and a paper feeding section 1B having a plurality of paper feeding cassettes 24 is provided in the lower portion of the copying machine body 1*a*.

The image forming section 1A will be described with reference to FIG. 2 showing the internal construction of the copying machine body 1*a*.

A photosensitive drum 2 as an image carrier is rotatably provided within the copying machine body 1*a*. Around the photosensitive drum 2 are disposed, along the rotational direction thereof, a charging unit 5 for charging the surface of the photosensitive drum 2 to a prescribed potential, a developing device 8B for monochro for developing an electrostatic latent image, a rotational type developing device 8A for color, an intermediate transfer belt 3 for temporarily transferring a developer image, and a cleaner 6 for removing a residual toner on the photosensitive drum 2.

The rotational type developing device 8A for color has a first developing portion 8*a* for supplying a yellow toner, a second developing portion 8*b* for supplying a cyan toner, and a third developing portion 8*c* for supplying a magenta toner.

The intermediate transfer belt 3 is stretched by a fixed tension between a first to fourth rollers 3*a* to 3*d*, and pressed against the photosensitive drum 2 by a primary transfer roller 12. A cleaner 15*a* for cleaning the intermediate transfer belt 3 is placed in contact with the portion of the intermediate transfer belt 3 to be wound about the first roller 3*a*.

An exposing device 4 for forming an electrostatic latent image on the photosensitive drum 2 is provided downward of the developing devices 8A, 8B.

The paper feeding section 1B having the paper feeding cassettes 24 encased therein is provided downward of the exposing device 4. The paper feeding cassette 24 is provided with a pickup roller 7 for taking out sheets. The sheets taken out by the pickup roller 7 are separated sheet by sheet by the paper feeding roller 15 and the separation roller 16 and delivered, and carried along a carrier passage 19.

The carrier passage 19 is brought nearer to one side wall law (see FIGS. 1 and 3) of the copying machine body 1*a*, and provided extending vertically along the one side wall law. The one side wall law has an opening for exposing the carrier passage 19 to carry out jam treating.

Within the carrier passage 19 are disposed, along the carrier direction of paper, paired paper guides 31, paired carrier rollers 9, paired resist rollers 17, and a secondary transfer roller 11 described later in order The paired resist rollers 17 stop paper to be carried once, correct inclination of paper with respect to the carrier direction, and coincide the extreme end of paper with the extreme end of a toner image on the intermediate transfer belt 3.

Downward in the paper carrier direction of the secondary transfer roller 11 is disposed a fixing unit 13 for fixing a toner image transferred to the paper to the paper. The fixing unit 13 has a heating roller 13*a* and a pressing roller 13*b*.

On the downstream side of the paper carrier direction of the fixing unit 13 is provided a discharge roller 20 for discharging the paper outside the copying machine body 1*a*. A discharge tray 21 for receiving paper to be discharged is provided on the take-out side of the discharge roller 20.

Printing operation of the electro-photographic copying machine 1 will be described hereinafter on the basis of the structure of the image forming section 1A described so far.

First, a document is set on a document carrier unit not shown, and a copy button of an operation panel not shown is turned on. Thereby, the document is carried, and information on the document is optically read by a reading device (not shown). At this time, the surface of the photosensitive drum 2 is uniformly charged by the charging unit 5. And, information light according to read information is irradiated by the exposing device 4 on the charged photosensitive drum 2 to form an electrostatic latent image.

This electrostatic latent image is sent to the developing device 8B or the developing device 8A by rotation of the photosensitive drum 2. Then, a black toner is supplied from the developing device 8B, or toners of cyan, magenta, and yellow are supplied from the developing device 8A for development. The developed toner image is sent onto the intermediate transfer belt 3 by rotation of the photosensitive drum 2, and subjected to primarily transfer by the primary transfer roller 12. After this transfer, the photosensitive drum 2 is photo-eliminated by a static eliminator (not shown). The toner stayed on the photosensitive drum 2 is cleaned by the cleaner 6.

On the other hand, the paper to be supplied through the carrier passage 19 from the paper feeding cassette 24 is fed in between the intermediate transfer belt 3 and the secondary transfer roller 11 while adjusting to the above-described operation and timing. The toner image on the intermediate transfer belt 3 is secondary-transferred on the paper. After transfer, the paper is peeled off from the intermediate transfer belt 3 and sent to the fixing unit 3, where the toner image is heated by the fixing unit 13, pressed and fixed. After fixing, the paper is discharged outside through the discharge roller 20, and placed on the discharge tray 21.

Figure 3:
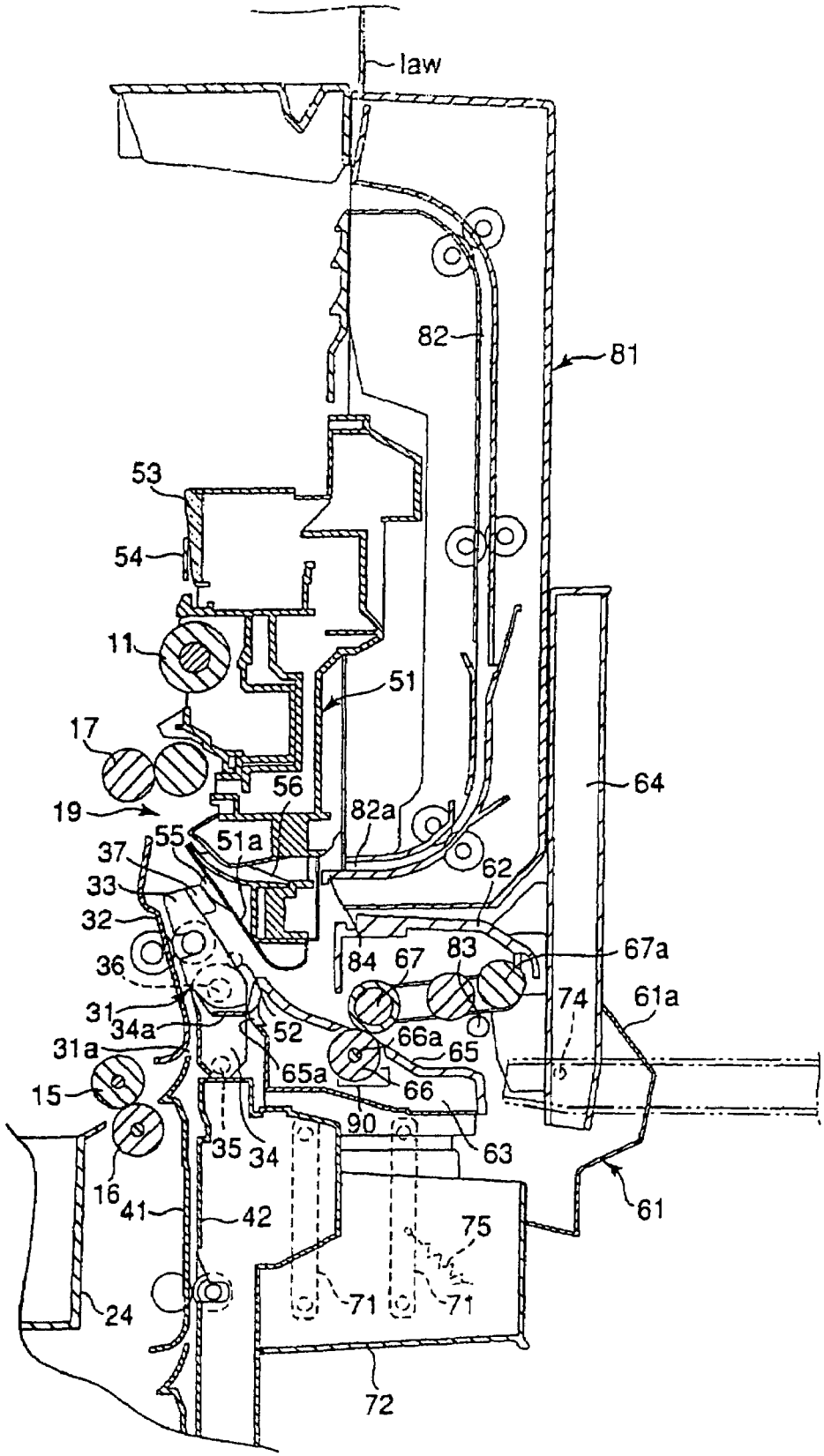
FIG. 3 is a sectional view showing an area around an automatic both-side unit and a manual paper feeding device of the electro-photographic copying machine of FIG. 1.
Figure 4:
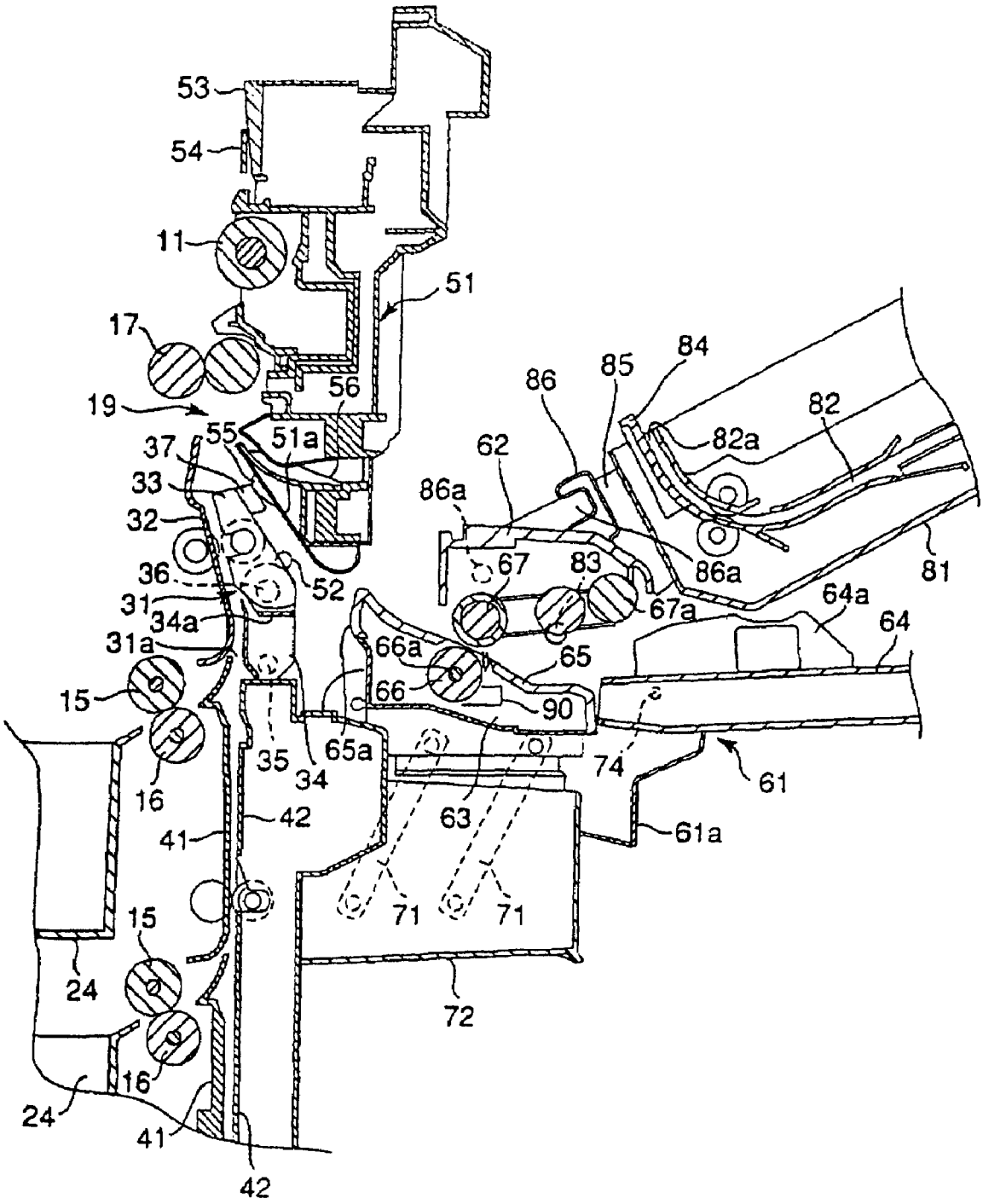
FIG. 4 is a sectional view showing the state that the automatic both-side unit of FIG. 3 is used.

Returning to explanation of the structure, as shown in FIGS. 3 and 4, the paired paper guide 31 provided on the carrier passage 19 has a paper guide for fixing 32 and a pair of upper and lower paper guides for movable 33, 34. An inlet 31*a* formed in the lower end of the paired paper guide 31 is positioned on the paper take-out side of the paired rollers of the paper feeding roller 15 and the separation roller 16 close to the paired rollers. The paper guide for fixing 32 is formed by a guide plate.

The paper guide for movable 34 at the lower position is mounted on the copying machine body 1 a free to turn about the lower end thereof. In FIGS. 3 and 4, reference numeral 35 denotes a pivot about the paper guide for movable 34. The paper guide for movable 34 is disposed opposite to the lower portion of the paper guide for fixing 32.

The lower end of the paper guide for movable 33 at the upper position and the upper end of the paper guide for movable 34 are connected by the pivot 36, and the paper guide for movable 33 can be turned freely about the pivot 36 with respect to the paper guide for movable 34. The paper guide for movable 33 is disposed opposite to the upper portion of the paper guide for fixing 32. One side surface opposite to the paper guide for fixing 32 of the paper guide for movable 33 is a first paper guide surface for guiding paper from the paper feeding section 1B. The other side surface of the paper guide for movable 33 positioned opposite to the one side surface is a second paper guide surface for guiding manual paper P (shown in FIG. 1). On the second paper guide surface is provided an engaging convex for interlocking 37 at a position not to obstruct carrying of the manual paper P. The engaging convex 37 is positioned upward of the pivot 36.

The pair of upper and lower paper guides for movable 33 and 34 are fallen clockwise in FIG. 3 due to the weight balance thereof. In other words, the paired paper guides 31 are formed to be opened.

In FIGS. 3 and 4, reference numerals 41, 42 denote paper guides for fixing provided extending vertically within the paper feeding section 1B opposite to each other. The upper end of the carrier passage within the paper feeding section formed in these paper guides 41, 42 is communicated with the inlet 31*a* of the paired paper guides 31. Accordingly, the sheets from the paper feeding cassette 24 moving up through the carrier passage is taken into the paired paper guides 31.

On one side wall 1*aw* of the copying machine body 1*a* is provided an opening and closing cover 51 for opening and closing an opening of the one side wall law as shown in FIGS. 1 and 2. Further, on the one side wall 1*aw* is arranged an automatic double-side unit 81 (ADU) positioned externally of the opening and closing cover 51 so as to cover the opening and closing cover 51. Further, on the one side wall law is provided a manual paper feeding device 61 (SFB) adjacent to the automatic double-side unit 81 on the lower side of the automatic double-side unit 81.

Figure 6:
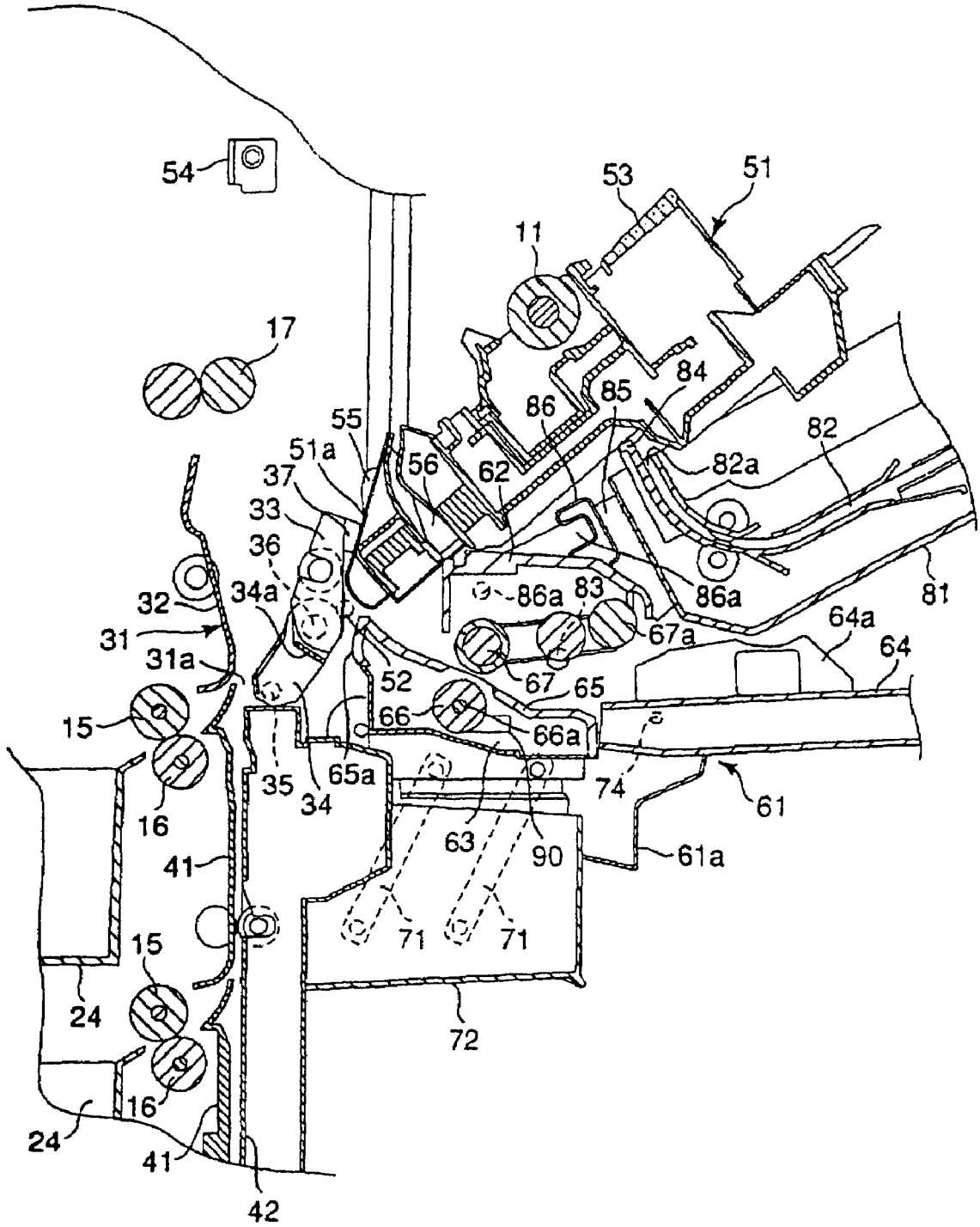
FIG. 6 is a sectional view showing the state that an opening and closing cover is opened from the state of FIG. 4.

The opening and closing cover 51 is mounted free to turn over a closed position shown in FIGS. 3 and 4 and an open position shown in FIG. 6 about the lower end thereof. In FIGS. 3, 4 and 6, reference numeral 52 denotes a pivot about the opening and closing cover 51. The pivot 52 is positioned upward of the pivots 35 and 36. A magnet 53 is mounted on the upper end of the opening and closing cover 51, and the opening and closing cover 51 is held at a closed position closing an opening of the one side wall law by magnetic adsorption carried out by the magnet 53 and an iron element 54 provided on the copying machine body 1*a*. Of course, the opening and closing cover 51 at a closed position is opened by manual operation.

The secondary transfer roller 11 is supported on the upper portion of the opening and closing cover 51. The opening and closing cover 51 has a paper guide 51*a* at the lower portion thereof. The paper guide 51*a* is opposed close to the second paper guide surface of the paper guide for movable 33 when the opening and closing cover 51 is arranged at a closed position. The paper guide 51*a* is provided with an engaging convex for interlocking 55 at a position upward of the pivot 52 and not to obstacle carrying the manual paper P. This engaging convex 55 is able to move to and from the engaging convex 37. That is, the engaging convex 55 is away from the engaging convex 37 in the state that the opening and closing cover 51 is arranged at an open position. Conversely, as the opening and closing cover 51 turns from an open position to a closed position, the engaging convex 55 comes in contact with the engaging convex 37, and after the contact, maintains its contact state so as to turn the paper guides for movable 33 and 34 in the direction in contact with the paper guide for fixing 32.

The opening and closing cover 51 has a paper passage 56 at the lower portion thereof. This paper passage 56 guides paper subjected to double-side printing guided by the automatic double-side unit 81 to the paired resist rollers 17.

The manual paper feeding device 61 is provided with a manual paper introducing portion 62 at the upper portion, a manual paper introducing portion 63 at the lower portion, and a manual tray 64 which are respectively mounted on an apparatus frame 61*a*. A pair of upper and lower manual paper introducing portions 62 and 63 are provided on the open side of the paper guides for movable 33 and 34 in order to guide manual paper P placed on the manual tray 64 to the middle portion of the carrier passage 19. The lower manual paper introducing portions 63 has an oblique introducing guide wall 65 for guiding the manual paper. A paper feeding roller 67 as a delivery portion and a take-out roller 67*a* are mounted on the upper manual paper introducing portion 62. The manual paper P from the manual tray 64 is delivered to the image forming section 1A through the carrier passage 19 by the paper feeding roller 67 and the take-out roller 67*a*. Further, on the manual paper introducing portions 63 is mounted a separation roller 66 as a separation portion so as to be exposed from the intermediate portion of an introducing guide wall 65. This separation roller 66 is in rolling contact with the paper feeding roller 67. This separation roller 67 is pressed against the paper feeding roller 67. Further, a torque limiter 66*b* is fitted in the separation roller 66, and where a plurality of manual paper P are taken out once by the take-out roller 67*a*, only one sheet at the uppermost level is delivered by the paper feeding roller 67, but the remaining manual paper P are not delivered because rotation of the separation roller 66 is stopped by the load received from the torque limiter 66*b*. That is, the manual paper P are separated and fed sheet by sheet by the separation roller 66.

The manual paper introducing portions 62 and 63 are provided movably from a set position (a first position) enabling feeding paper manually to the carrier passage 19 shown in FIG. 3 to a lateral point (an open position) away from the side of the copying machine body 1*a* shown in FIGS. 4 and 6. More specifically, the manual paper introducing portions 62 and 63 are provided capable reciprocating in the horizontal direction from the set position to a withdrawal position deviated from a movable area of the paper guides for movable 33, 34 at the time of jam treatment. In the state that the manual paper introducing portions 62 and 63 are arranged at the set position, the inclined upper end of the introducing guide wall 65 is arranged on the lower end of the passage between the second paper guide surface of the paper guide for movable 33 and the paper guide 51*a*, and the manual paper P guided to the introducing guide wall 65 can be guided to the carrier passage 19 passing through the previously mentioned passage.

A pressing portion 65*a* moving to and from the paper guide for movable 34 is provided on the manual paper introducing portion 63. This pressing portion 65*a* is prepared, for example, by a portion bended downward from the inclined upper end of the introducing guide wall 65. As the manual paper introducing portions 62 and 63 are arranged at the set position, the pressing portion 65*a* is pressed against a receiving portion 34*a* of the paper guide for movable 34 to hold the paired paper guides 31 in the closed state. As the manual paper introducing portions 62 and 63 are arranged at the withdrawal position, the pressing portion 65*a* is moved away from the receiving portion 34*a* to enable opening the paired paper guides 31.

The manual paper introducing portions 62 and 63 are provided with, for example, four links 71 constituting a parallel link mechanism for integrally reciprocating these introducing portions 62 and 63. The links 71 are provided two by two on both sides in the width direction of the manual paper feeding device 61. Each link 71 has an upper end pivoted to the manual paper introducing portion 63, and a lower end pivoted to a bracket 72 mounted on the one side wall 1*aw*.

The manual tray 64 is provided free to turn about a pivot 74 between a horizontal using position and a vertical un-using position. This turning is done manually. The manual tray 64 arranged at the using position is arranged continuously to the inclined lower end of the lower manual paper introducing portion 63. Therefore, feeding of the manual paper P placed on the manual tray 64 can be done. In FIGS. 4 and 6, reference numeral 64*a* denotes a guide plate for positioning the manual paper P on the manual tray 64.

The manual paper feeding device 61 provided with the above-described structure is always biased toward the withdrawal position by a bias means. As the bias means, a coil spring 75 (shown only in FIG. 3) is used. This coil spring 75 has, for example, one end connected to the middle of the link 71, and the other end connected to the bracket 72 supporting the link 71 to hold the compressed state whereby the manual paper feeding device 61 is biased toward the withdrawal position by the elastic repulsion.

Figure 5:
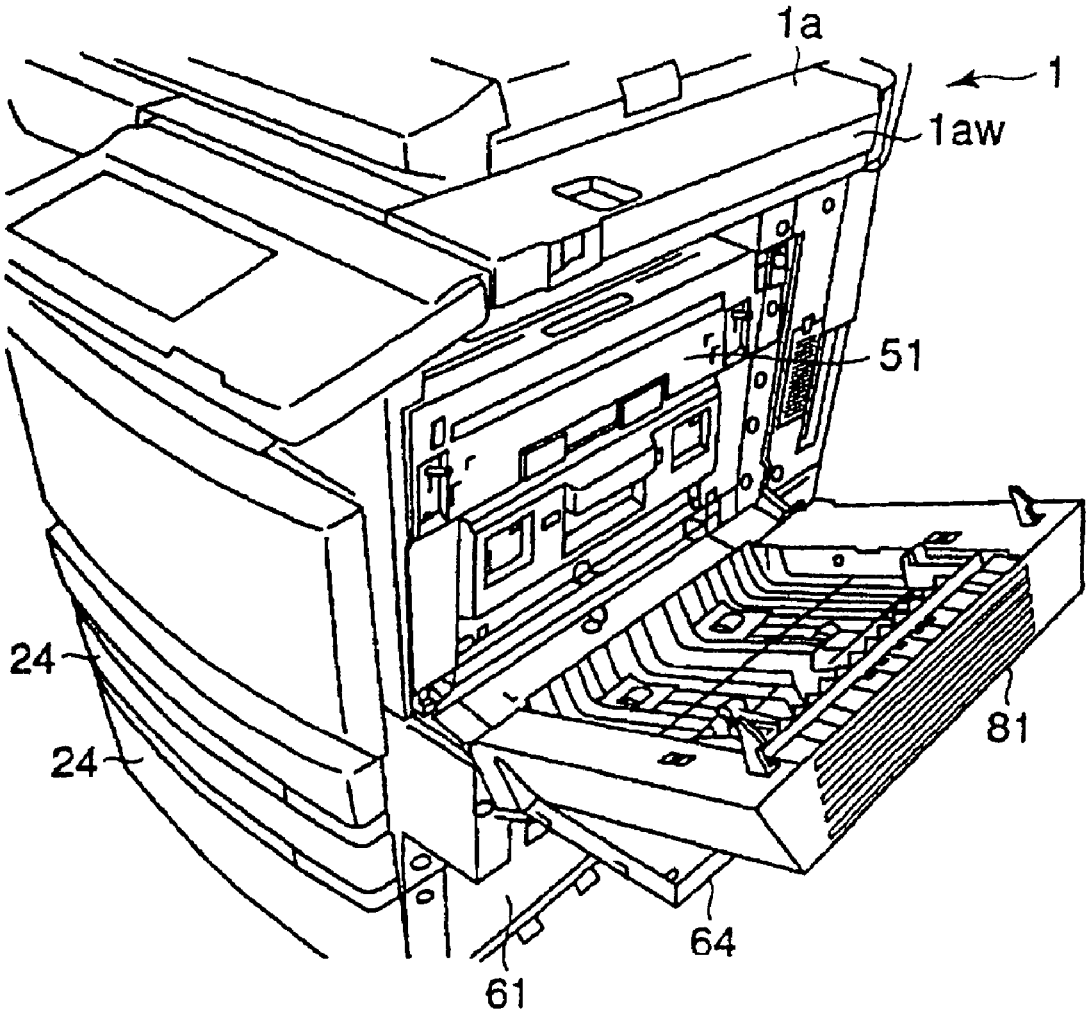
FIG. 5 is likewise a perspective view.

The automatic double-side unit 81 has, for example, a flat external form. There is formed, internally, a reverse carrier passage 82 for reversing the paper subjected to double-side printing to carry it to the image forming section 1A. Turing levers 85 (only one is shown in FIGS. 4 and 6) project from both sides in the width direction of the lower end of the automatic double-side unit 81. The lower ends of the turning levers 85 are supported free to turn on the copying machine body 1*a*. Thereby, the automatic double-side unit 81 is supported on the copying machine body 1*a* free to turn about the lower end, and then mounted free to open and close on the side of the copying machine body 1*a*. In FIGS. 3, 4, 6 and 7, reference numeral 83 denotes a pivot about the automatic double-side unit 81. That is, the automatic double-side unit 81 has the structure in which it can be turned as shown in FIG. 5 from a closed position mounted and held on the one side wall 1 aw as shown in FIG. 3 to an open position shown in FIGS. 4 and 6. This turning is done manually. When the automatic double-side unit 81 is arranged at a closed position, an outlet 82*a* of the reversing carrier passage 82 is communicated with the paper passage 56 of the opening and closing cover 51.

In the vicinity of the outlet 82*a* of the automatic double-side unit 81, there is formed an interlocking convex 84 projecting forward of the outlet 82*a*. When the automatic double-side unit 81 is turned from an open position to a closed position, the interlocking convex 84 touches the opening and closing cover 51 from the outer surface side thereof to close the opening and closing cover 51.

A hook-like interlocking member 86 is mounted, as shown in FIGS. 4 and 6, on the turning lever 85 of the automatic double-side unit 81. As the automatic double-side unit 81 turns, the interlocking member 86 can be engaged or disengaged from an interlocking pin 86*a* provided on the upper manual paper introducing portion 62. By the engaging and disengaging structure, in the state that the automatic double-side unit 81 is arranged at a closed position shown in FIG. 3, the interlocking pin 86*a* is brought into engagement with a concave 86*a* of the interlocking member 86 in the entered state. By this engagement, the manual paper feeding device 61 is held at the set position against the bias force of the coil spring 75. Further, in the state that the automatic double-side unit 81 is arranged at an open position shown in FIGS. 4 and 6, the interlocking member 86 is disengaged from the interlocking pin 86*a*, as a result of which the manual paper feeding device 61 is extruded by the bias force of the coil spring 75 to the open position. That is, when the automatic double-side unit 81 is operated to be opened as shown in FIGS. 4 to 6, the manual paper feeding device 61 is moved (to an open position) horizontally in the direction moving away from the side (a set position) of the copying machine body 1*a* in interlocking with the opening operation, with the interlocking member 86, the interlocking pin 86*a* and the coil spring 75 as manual moving means. Further, by the construction of the turning support of the automatic double-side unit 81, a portion (an open portion) between the side of the copying machine body 1*a* and the manual paper feeding device 61 away from the copying machine body 1*a* is exposed to outside.

Figure 7:
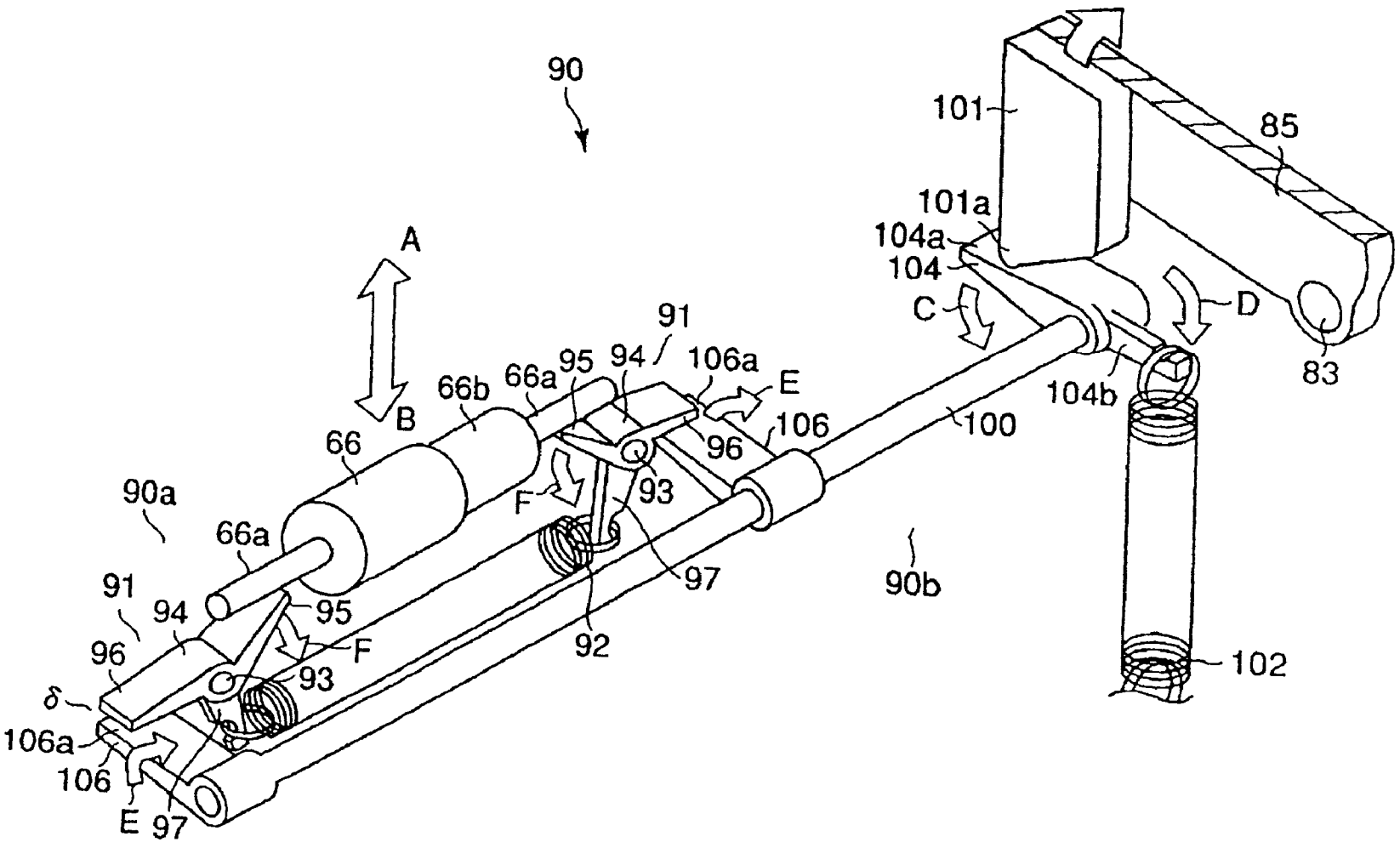
FIG. 7 is a perspective view for explaining a pressure contact release mechanism for releasing pressure contact between a paper feeding roller and a separation roller.

Further, internally of the lower manual introducing portion 63 is provided a pressure contact release mechanism 90 as a pressure contact release means for releasing pressure contact between the separation roller 66 and the paper feeding roller 67 as shown in FIGS. 3, 4 and 6. The construction of the pressure contact release mechanism 90 is shown in FIG. 7. Describing the construction, the pressure contact release mechanism 90 has a bias mechanism portion 90*a* as a bias means for normally biasing the separation roller 66 toward the paper feeding roller 67, and a release mechanism portion 90*b* as a release means for releasing biasing of the separation roller 66 with respect to the paper feeding roller 67 when the automatic double-side unit 81 is opened. In the bias mechanism portion 90*a* is used the structure in which using the separation roller 66 which is movable in the upper direction A close to and in the lower direction B away from the paper feeding roller 67 (not shown in FIG. 7), pressure contact force is applied to supporting shaft portions 66*a* projecting from both ends, respectively, of the separation roller 66. As the construction for applying the pressure contact force, there is used a construction comprising a combination of a pair of pressing levers 91 free to turn vertically about a horizontal axis perpendicular to an axis, for example, of the separation roller 66, for example, disposed on the lower side of each shaft portion 66*a* and a pressing bias member, for example, a pulling coil spring 92. More specifically, the pair of pressing levers 91, for example, has a lever construction divided into three, more specifically, a pivot 93 as a support point, a boss portion 94 supported free to turn on the pivot 93, a push-up portion 95 projecting from the boss portion 94 to the lower side of the shaft portion 66*a*, a receiving portion 96 projecting from the boss portion 94 to the side opposite to the push-up portion 95, and a spring receiving portion 97 projecting from the boss portion 94 to the lower side. The coil spring 92 is stretched between the spring receiving portions 97 of the pair of pressing levers 91. And, the shaft portions 66*a* on both ends of the separation roller 66 are pushed up by the push-up portion 95 biased upward by the pulling force of the coil spring 92. By pushing up these shaft portions 66*a*, the separation roller 66 is pressed in the direction close to the paper feeding roller 67 to bring the separation roller 66 into pressure contact with the paper feeding roller 67.

In the release mechanism portion 90*b*, there is used a construction comprising a combination of a transmission shaft with a lever 100 (hereinafter merely referred to as a transmission shaft 100) disposed free to turn sideways of a pair of pressing levers 91, for example, on the lower end side of an oblique introducing guide wall 65, a pusher 101 provided on the lower portion of a turning lever 85 on one side of the automatic double-side unit 81, and a bias member for releasing pressing, for example, a pulling spring coil 102. As the coil spring 102, a spring whose pulling force is determined by the pressing coil spring 92 is used. Explaining the release mechanism portion 90*b* in detail, for example, the transmission shaft 100 is disposed in parallel with the axis of the separation roller 66 between the pair of pressing levers 91. And, one end of the transmission shaft 100 projects near the turning lever 85 where the pusher 101 is present. To this end is secured the pressing lever 104. The pressing lever 104 is formed from a lever member whose extreme end projects to a pressing portion 101*a* formed at the lower end of the pusher 101. The coil spring 102 is connected, for example, to a spring stop seat 104*b* projected from the rear end of the pressing lever 104. And, the transmission shaft 100 is biased clockwise by the pulling force of the coil spring 102 to press a receiving surface 104*a* formed on the upper surface of the pressing lever 104 against the pressing portion 101*a* of the pusher 101 Thereby, when the automatic double-side unit 81 is arranged at a closed position, the pressing lever 104 is pushed down counterclockwise C by the pusher 101 as shown in FIG. 7. Further, when the automatic double-side unit 81 is turned to an open position, the pressing lever 104 is turned and displaced clockwise D while keeping the state in contact with the pusher 101.

Further, a pair of release levers 106 are secured to each shaft portion corresponding to positions at which a pair of pressing lever 91 are present out of the transmission shaft 100. The pair of release levers 106 are respectively formed from a lever member whose extreme end projects directly under the receiving portion 96 of the pressing lever 91. Further, the release lever 106 is set so that in the state that the automatic double-side unit 81 is arranged at a closed position, a clearance 6 is formed between the pressing surface 106*a* formed on the upper surface of the release lever 106 and the receiving portion 96 of the pressing lever 91 Further, when the automatic double-side unit 81 is opened from a closed position, the release lever 106 is turned clockwise E in FIG. 7 by the elastic force of the coil spring 102. By the turning displacement clockwise E, the pressing surface 106*a* comes in contact with the receiving portion 96, and pushes up the receiving portion 96 of the pressing lever 91 while overcoming the elastic force of the coil spring 92, and pushes down the push-up portion 95 on the opposite side in the direction of arrow F in FIG. 7. That is, when the automatic double-side unit 81 is opened, the separation roller 66 is fallen in the lower direction B due to its own weight so as to move away from the paper feeding roller 67. By the parting operation of the separation roller 66, the pressure contact between the separation roller 66 and the paper feeding roller 67 is released in association with the opening operation of the automatic double-side unit 81.

In the electro-photographic copying machine 1 having the automatic double-side unit 81 and the manual paper feeding device 61 mounted thereon, in the normal state, the paired paper guides 31 are closed as shown in FIG. 3, and the opening and closing cover 51 and the automatic double-side unit 81 are respectively arranged at a closed position. Further, the manual paper feeding device 61 is arranged at a set position, and the manual tray 64 is stood approximately vertically so as to superpose to the lower outer surface of the automatic double-side unit 81.

In the normal state, the sheets within the paper feeding cassette 24 of the paper feeding section 113 can be fed to the image forming section 1A and printed as mentioned previously. Where at the time of printing, double-side printing is designated, the paper having one side printed is switched back by the discharge roller 20, passes the reverse carrier passage 82 of the automatic double-side unit 81, and again fed to the image forming section IA via the carrier passage 19 for double-side printing.

Where manual paper feeding is necessary, the manual tray 64 is fallen so as to assume a horizontal attitude as shown by two-dotted contour line in FIG. 3, and then the manual sheets of paper P are placed on the tray 64 and set, whereby the manual paper P is fed to the image forming section 1A via the carrier passage 19, thereby applying printing to the surface of the paper P.

It is supposed that at this time, the jam of the paper P occurs in the vicinity of the manual paper feeding device 61.

In this case, first, the automatic double-side unit 81 arranged at a closed position as shown in FIG. 5 is turned manually to assume an open position. By turning of the automatic double-side unit 81, the engagement between the interlocking member 86 and the interlocking pin 86*a* of the manual paper feeding device 61 is disengaged. Thereby, restriction of the manual paper feeding device 61 is released. Then, the manual paper feeding device 61 is horizontally moved (to a prescribed withdrawal position) in the direction away from the paired paper guides 31 by the elastic force of the coil spring 75 in interlocking with the opening automatic double-side unit 81. On the other hand, in the pressure contact release mechanism 90 as shown in FIG. 7, limitation of the pressing lever 104 is released by movement of the pusher 101 as the automatic double-side unit 81 turns. Then, the transmission shaft 100 is turned and displaced clockwise by the elastic force of the coil spring 102 in excess of the pressing coil spring 92. Thereby, the pressing lever 91 is turned and displaced forcibly in the pressing releasing direction (F direction) for releasing pressing by the release lever 106. Then, the separation roller 66 is fallen (lower direction B) due to its own weight to release the pressure contact with respect to the paper feeding roller 67.

That is, when the automatic double-side unit 81 is operated to be opened, an open space is formed between the side of the copying machine body 1*a* and the manual paper feeding device 61 as shown in FIG. 4. The open space at this time is exposed between the open automatic double-side unit 81 and the copying machine body 1*a*, and therefore, a work space in which jam treatment work is easily done, which is opened to the place contemplated to be jammed, is formed between the copying machine body 1*a* and the automatic double-side unit 81, the manual paper feeding device 61. Moreover, since the pressure contact between the separation roller 66 and the paper feeding roller 67 is released, the circumstances in which the paper P is easily taken out from and between the manual paper introducing portions 62 and 63 are formed.

Suppose that the jammed paper P is present in the manual paper feeding device 61, an operator may remove the paper P in the free state not sandwiched between the separation roller 66 and the paper feeding roller 67, from the manual paper feeding device 61 through the work space secured by the withdrawal operation of the manual paper feeding device 61 from the open portion formed between the copying machine body 1*a* and the manual paper feeding device 61. It is noted that if the automatic double-side unit 81 is returned to a closed position, the separation roller 66 returns again to the state that is placed in pressure contact with the paper feeding roller 67, and the manual paper feeding device 61 returns again to a set position.

Therefore, the jammed paper P can be easily removed with less labor and under the circumstances in which work is done easily, in spite of the electro-photographic copying machine 1 equipped with the automatic double-side unit 81 and the manual paper feeding device 61. Particularly, in the construction in which the automatic double-side unit 81 is supported free to turn on the side of the copying machine body 1*a*, the portion between the manual paper feeding device 61 and the copying machine body 1*a* is simply exposed to outside. Moreover, the pressure contact release mechanism 90 is the mere structure in which the construction for releasing the bias in association with the opening operation of the automatic double-side unit 81 is combined with the construction for normally biasing the separation roller 66 against the paper feeding roller 67, and therefore, the mechanism 90 is simple and high in reliability.

Further, the opening and closing cover 51 used for jam treatment within the copying machine body 1*a* is provided on the side of the copying machine body 1*a* covered by the automatic double-side unit 81, whereby if necessary for jam treatment of the paper P, if the opening and closing cover 51 is turned manually, restriction of the paper guide for movable 33 is released. Then, the upper and lower paper guides for movable 33, 34 are moved away from the paper guide for fixing 32 following opening of the opening and closing cover 51, and the paired paper guides 31 are automatically opened so as to greatly part the upper side thereof as shown in FIG. 4. Therefore, even if the paper P becomes jammed in the carrier passage 19, jam treatment can be carried out easily.

The present invention is not limited to the aforementioned embodiment, but various changes within the scope not departing the spirit of the present invention may be made.

What is claimed is:

1. An image forming apparatus, comprising:

an apparatus body encasing an image forming section;

a member having a feeding portion provided free to open and close on the side of said apparatus body to reverse paper and feed it to said image forming section;

a manual paper feeding device provided on the side of said apparatus body adjacent to said member having a feeding portion, and having a delivery portion for delivering paper to said image forming section and a separation portion in pressure contact with said delivery portion and in which where a plurality of paper are delivered by said delivery portion, sheets after the second sheet are separated;

a moving mechanism configured to move said manual paper feeding device in a direction away from the side of said apparatus body in association with opening operation of said member having a feeding portion; and a pressure contact release mechanism configured to release pressure contact between said delivery portion and said separation portion in association with opening operation of said member having a feeding portion, wherein said moving mechanism is constituted by a mechanism for displacing said manual paper feeding device so as to be moved away in a horizontal direction from said apparatus body.

2. The image forming apparatus according to claim 1, further comprising a transfer member placed in contact with an image carrying member.

3. The image forming apparatus according to claim 2, wherein said transfer member is moved away from said image carrying member in association with opening operation of said member having a feeding portion and is contacted with said image carrying member in association with closing operation of said member having a feeding portion.

4. The image forming apparatus according to claim 1, wherein said member having a feeding portion is supported free to turn on the side of said apparatus body so that when opening operation is done, a portion between said apparatus body and said manual paper feeding device away from said apparatus body is exposed to outside.

5. The image forming apparatus according to claim 1, wherein said pressure contact release mechanism comprises a bias mechanism configured to normally bias the separation portion to said delivery portion, and a release mechanism configured to release the bias of said separation portion with respect to said delivery portion when said member having a feeding portion is opened.

6. The image forming apparatus according to claim 1, wherein said apparatus body has an opening and closing cover to be opened at the time of jam treatment within said apparatus body, on the side portion covered by said member having a feeding portion.

7. The image forming apparatus according to claim 3, wherein said member having a feeding portion is supported free to turn on the side of said apparatus body so that when opening operation is done, a portion between said apparatus body and said manual paper feeding device away from said apparatus body is exposed to outside.

8. The image forming apparatus according to claim 3, wherein said pressure contact release mechanism comprises a bias mechanism configured to normally bias the separation portion to said delivery portion, and a release mechanism configured to release the bias of said separation portion with respect to said delivery portion when said member having a feeding portion is opened.

9. The image forming apparatus according to claim 3, wherein said apparatus body has an opening and closing cover to be opened at the time of jam treatment within said apparatus body, on the side portion covered by said member having a feeding portion.

10. An image forming apparatus, comprising:

an apparatus body encasing an image forming section;

a member having a feeding portion provided free to open and close on the side of said apparatus body to reverse paper and feed it to said image forming section;

a manual paper feeding device provided on the side of said apparatus body adjacent to said member having a feeding portion, and having a delivery portion for delivering paper to said image forming section and a separation portion in pressure contact with said delivery portion and in which where a plurality of paper are delivered by said delivery portion, sheets after the second sheet are separated;

a moving mechanism configured to move said manual paper feeding device in a direction away from the side of said apparatus body in association with opening operation of said member having a feeding portion; and wherein said moving mechanism is constituted by a mechanism for displacing said manual paper feeding device so as to be moved away in a horizontal direction from said apparatus body.

11. The image forming apparatus according to claim 10, further comprising a transfer member placed in contact with an image carrying member.

12. The image forming apparatus according to claim 11, wherein said transfer member is moved away from said image carrying member in association with opening operation of said member having a feeding portion and is contacted with said image carrying member in association with closing operation of said member having a feeding portion.

13. The image forming apparatus according to claim 10, wherein said member having a feeding portion is supported free to turn on the side of said apparatus body so that when opening operation is done, a portion between said apparatus body and said manual paper feeding device away from said apparatus body is exposed to outside.

14. The image forming apparatus according to claim 10, wherein said apparatus body has an opening and closing cover to be opened at the time of jam treatment within said apparatus body, on the side portion covered by said member having a feeding portion.

15. The image forming apparatus according to claim 12, wherein said member having a feeding portion is supported free to turn on the side of said apparatus body so that when opening operation is done, a portion between said apparatus body and said manual paper feeding device away from said apparatus body is exposed to outside.

16. The image forming apparatus according to claim 12, wherein said apparatus body has an opening and closing cover to be opened at the time of jam treatment within said apparatus body, on the side portion covered by said member having a feeding portion.

* * * * *